United States Patent [19]

Beggs

[11] Patent Number: 4,502,177

[45] Date of Patent: Mar. 5, 1985

[54] TOOTHBRUSH

[76] Inventor: Russell J. Beggs, 211 Stockton Ave., #2, Capitola, Calif. 95010

[21] Appl. No.: 471,560

[22] Filed: Mar. 2, 1983

[51] Int. Cl.[3] ..... A46B 9/04

[52] U.S. Cl. ..... 15/167 R; 15/143 R

[58] Field of Search ..... 15/167 R, 167 A, 172, 15/176, 110, 143 R

[56] References Cited

U.S. PATENT DOCUMENTS

| | | | |
|---|---|---|---|
| 864,054 | 8/1907 | Abrams . | |
| 1,091,291 | 3/1914 | Carroll . | |
| 1,133,930 | 3/1915 | Carroll . | |
| 1,353,780 | 9/1920 | Mueller . | |
| 1,417,407 | 5/1922 | Novak . | |
| 1,513,104 | 10/1924 | Gracey | 15/167 R |
| 1,520,730 | 12/1924 | Street | 15/167 R |
| 1,595,715 | 8/1926 | Dudley | 15/167 R |
| 1,874,467 | 8/1932 | Doll | 15/167 R |
| 2,066,241 | 12/1936 | Trattner et al. . | |
| 2,077,392 | 4/1937 | Boyd . | |
| 2,114,947 | 4/1938 | Warsaw | 15/167 R |
| 2,237,694 | 4/1941 | Altstadt . | |
| 2,244,615 | 6/1941 | Garcin . | |
| 2,306,264 | 12/1942 | Hart . | |
| 2,588,601 | 3/1952 | Zavagno . | |
| 2,603,806 | 7/1952 | Kisky | 15/167 R |
| 3,087,183 | 4/1963 | Semon . | |
| 3,742,549 | 7/1973 | Scoop et al. | 15/167 R |
| 4,131,967 | 1/1979 | Northemann et al. . | |
| 4,137,593 | 2/1979 | Porper . | |
| 4,330,896 | 5/1982 | Booth | 15/167 R X |

FOREIGN PATENT DOCUMENTS

| | | | |
|---|---|---|---|
| 1168706 | 9/1958 | France | 15/167 R |
| 7787 | of 1886 | United Kingdom | 15/167 R |

*Primary Examiner*—Peter Feldman

*Attorney, Agent, or Firm*—Steven F. Caserza; Alan H. MacPherson

[57] ABSTRACT

My invention is carefully designed for the specific task of cleansing the lingual aspects of upper and lower anterior teeth and the distal aspects of the most distal teeth. Because my invention is not designed for the purpose of cleansing all surfaces of the teeth, but is designed to provide superior cleansing in those areas where a standard toothbrush is deficient, my toothbrush is designed to augment rather than to replace a standard toothbrush.

1 Claim, 9 Drawing Figures

FIG. 1
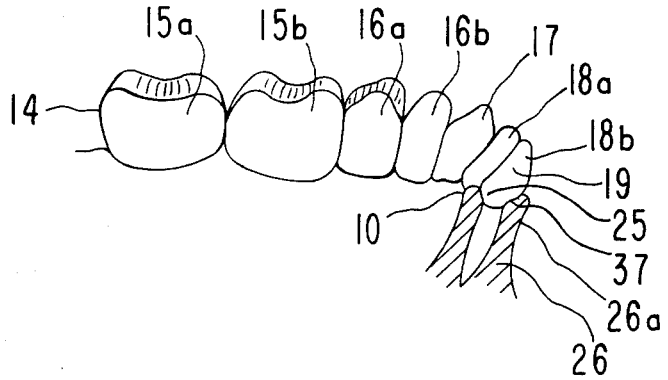
FIG. 2
PRIOR ART
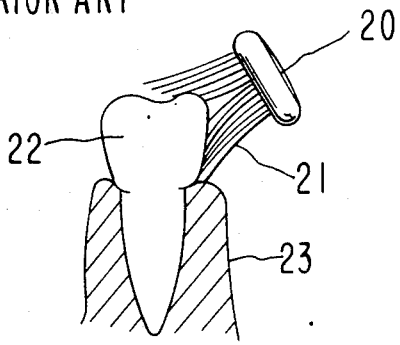
FIG. 3
PRIOR ART
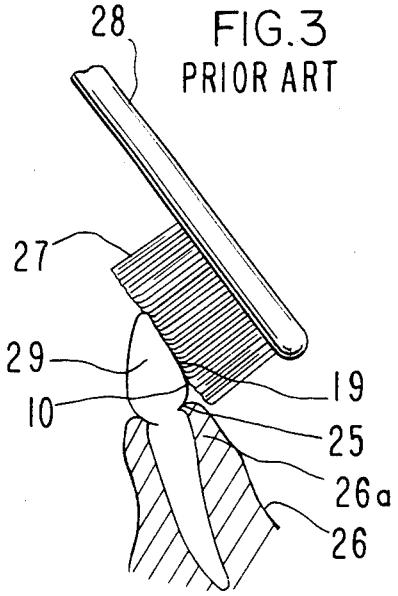
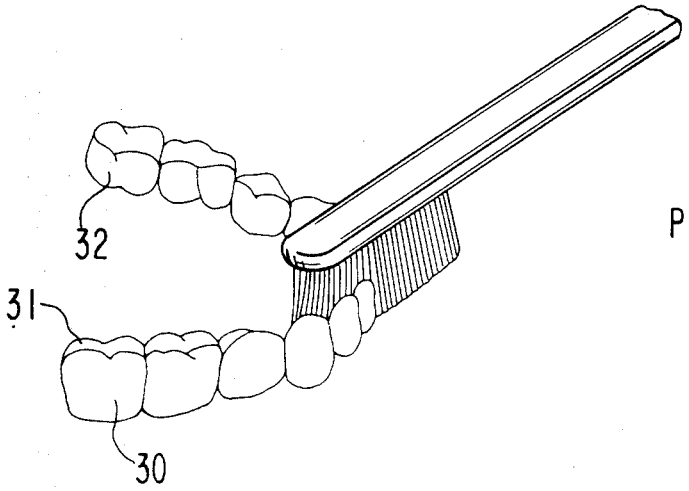
FIG. 4
PRIOR ART

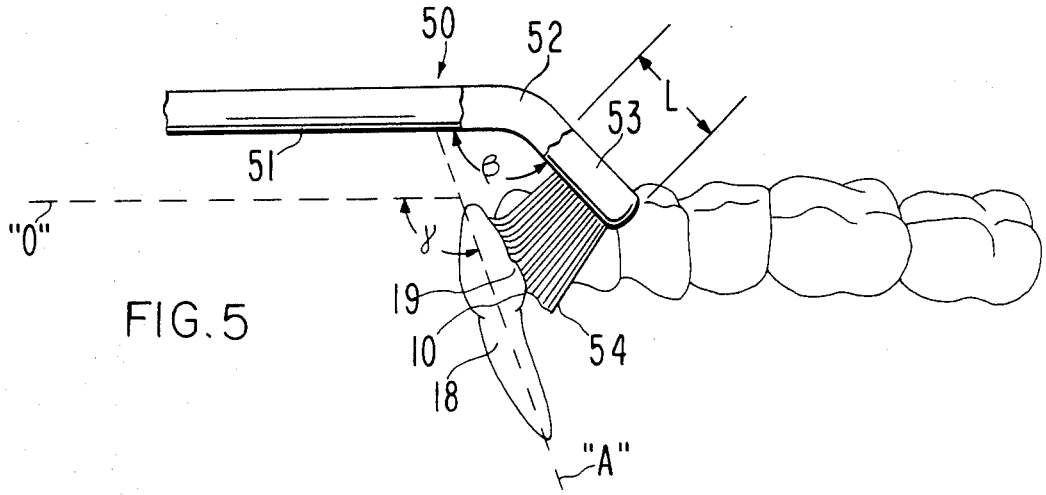
FIG. 5
FIG. 6
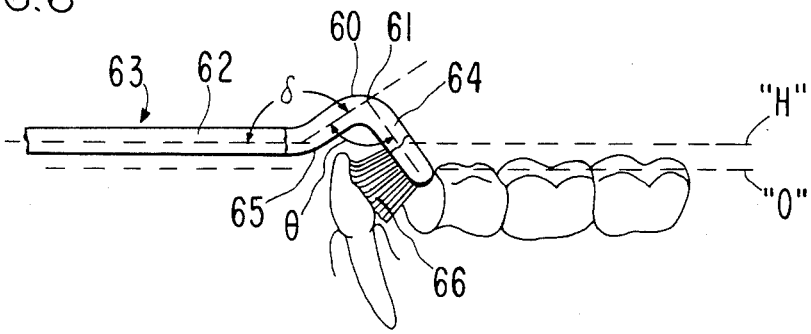
FIG. 7
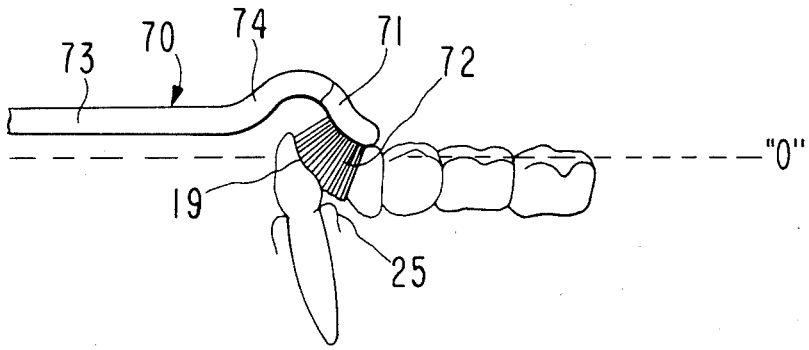

TOOTHBRUSH

BACKGROUND OF THE INVENTION

1. Field of the Invention

This invention relates to toothbrushes for use in maintaining oral hygiene.

2. Description of the Prior Art

There is a build up of stains, plaque, calculous and other local irritants on the lingual aspects 19 (FIG. 1) of Anterior teeth (i.e., the premolars 16*a*, 16*b*, cuspids 17, and incisors 18*a*, 18*b*), even in dentists and very hygienic patients. These local irritants are a known factor in the etiology of periodontal disease. Peridontal disease is one of the leading causes of tooth loss in adults. There is a build up of such local irritants on the lingual aspects of anterior teeth because they are not very efficiently removed even with careful and frequent use of a standard toothbrush of the prior art and the generally recommended "Modified Bass" toothbrushing technique for removing these irritants. In utilizing the Modified Bass technique, as shown in FIG. 2, the bristles 21 of the toothbrush 20 are held at approximately 45° to the surface of the teeth 22, and the brush is first moved slightly in a direction perpendicular to the length of the teeth (i.e., parallel to the gums 23) in order to loosen particles from the teeth. The brush is then moved along the length of the teeth away from the gums, in order to remove loosened particles from the teeth. This works well in cleaning the facial portions of the teeth, but this method is extremely difficult, if not impossible, to perform on the lingual aspects 15 of the anterior teeth 16, and the distal aspects of the most distal tooth, such as the distal aspect 14 of molar 15*a* (FIG. 1). For this reason, the Modified Bass technique states that, to clean the linqual aspect of the anterior teeth, the toothbrush is held, as shown in FIG. 3, approximately parallel to the lingual aspect of the teeth with the bristles engaging the tooth at an angle of approximately 90°. The modified technique makes no provision for cleaning the distal aspect of the most distal teeth, because the toothbrushes of the prior art are not suitable for cleaning the distal aspect of the most distal teeth.

The Modified Bass technique is not very efficient in cleansing the lingual aspects of anterior teeth and the distal aspect of the most distal teeth for at least two reasons. First, the shape of prior art toothbrushes is such that the bristles do not get down into the sucular areas 25 (FIG. 1). Utilizing a standard prior art toothbrush and the Modified Bass technique, the bristles 27 also impinge on the gingiva 26*a* (the portion of gums 26 nearest the crown 29 of the teeth). Because of the high sensitivity of gingiva 26*a*, it is very difficult for the patient to cleanse the sulcular area 25 without causing damage to the gingiva 26*a*. Secondly, it is extremely difficult to maneuver a standard prior art toothbrush as required by the Modified Bass technique in the lingual areas 19 of anterior teeth.

The so-called "REACH" toothbrush currently being marketed includes a head for containing bristles, the head being bent slightly from the handle. The REACH toothbrush also has shorter bristles toward the outer and longer bristles at the sides of the head, in an attempt to enhance sulcular cleansing when the toothbrush is held such that the bristles are parallel to the occlusal plane. This structure allows slightly improved access to the distal areas and lingual aspect of anterior teeth, but still not a significant improvement over the prior art toothbrushes.

Other prior art toothbrushes, other than prior art toothbrush 28 of FIG. 3, are generally designed to brush the three accessable surfaces of teeth simultaneously. These three accessable surfaces of the teeth are shown in FIG. 4, and comprise the facial surface 30, the occlusal surface 31, and the lingual surface 32. Such prior art brushes generally consist of either a horseshoe shaped head having bristles of even length, such as described in U.S. Pat. No. 864,054 or having bristles of various lengths, as shown in U.S. Pat. No. 1,133,930. U.S. Pat. No. 1,133,930 includes longer bristles for brushing the facial and lingual aspects of the teeth, and shorter bristles for brushing the occlusal surface of the teeth. Other prior art toothbrushes, such as described in U.S. Pat. No. 1,353,780 have multiple heads. These toothbrushes typically include two or three heads having a variety of angles and lengths, but their main function is to brush several accessable surfaces or all of the teeth simultaneously. Other prior art toothbrushes are designed to attempt to brush both the upper and the lower teeth, and still other prior art toothbrushes have a rotary head. However, the objective in such prior art toothbrushes is to clean the accessable surfaces of the teeth simultaneously. In spite of the number of attempts to design better toothbrushes, proper cleansing of the lingual aspects of the anterior teeth and the distal aspect of the most distal teeth remains elusive, with no prior art toothbrush providing a satisfactory cleansing of these troublesome areas of the teeth.

SUMMARY

In contrast to prior art toothbrushes, many of which are designed to clean several surfaces of the teeth simultaneously and which sacrifice proper cleansing of the teeth for the sake of speed, the toothbrush of my invention is not designed to brush all the surfaces of the teeth simultaneously. As a matter of fact, my invention is not designed to even brush all the surfaces of the teeth. My invention is carefully designed for the specific task of cleansing the lingual aspects of upper and lower anterior teeth and the distal aspects of the most distal teeth. Because my invention is not designed for the purpose of cleansing all surfaces of the teeth, but is designed to provide superior cleansing in those areas where a standard toothbrush is deficient, my toothbrush is designed to augment rather than to replace a standard toothbrush.

BRIEF DESCRIPTION OF THE DRAWING

FIG. 1 is a view depicting the left half of the lower dentition;

FIG. 2 is a drawing depicting a standard prior art toothbrush cleaning the facial surface of a tooth;

FIG. 3 is a view depicting a standard prior art toothbrush attempting to clean the lingual aspect of an anterior tooth;

FIG. 4 is a view depicting a standard prior art toothbrush cleansing the occlusal surface of a set of teeth;

FIG. 5 is a view depicting a toothbrush constructed in accordance with one embodiment of my invention cleansing the lingual aspect of an anterior tooth of the lower dentition;

FIG. 6 is a view depicting a toothbrush constructed in accordance with another embodiment of my invention cleansing the lingual aspect of an anterior tooth;

FIG. 7 is a view depicting a toothbrush constructed in accordance with another embodiment of my invention cleansing the lingual aspect of an anterior tooth;

DETAILED DESCRIPTION

Figure 8:
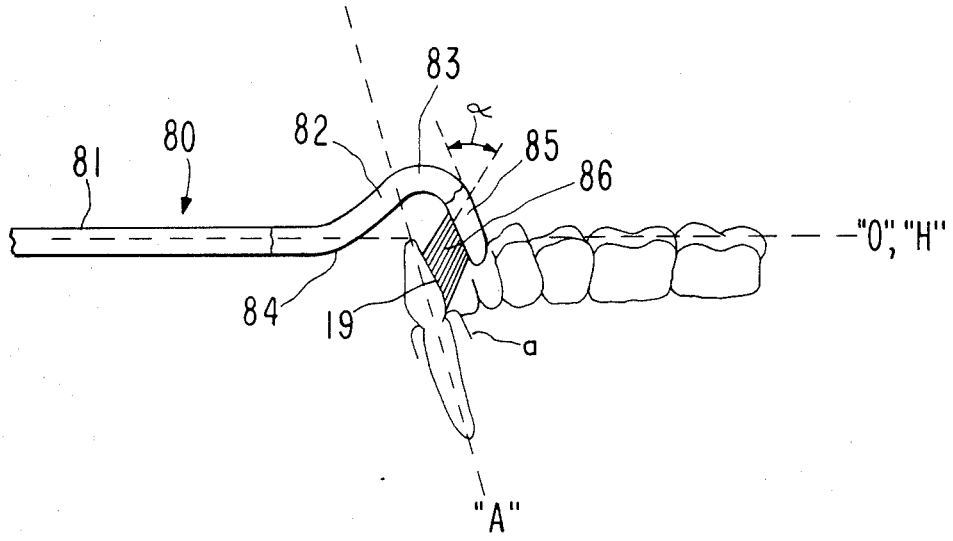
FIG. 8 is a view depicting a toothbrush constructed in accordance with another embodiment of my invention cleansing the lingual aspect of an anterior tooth.
Figure 9:
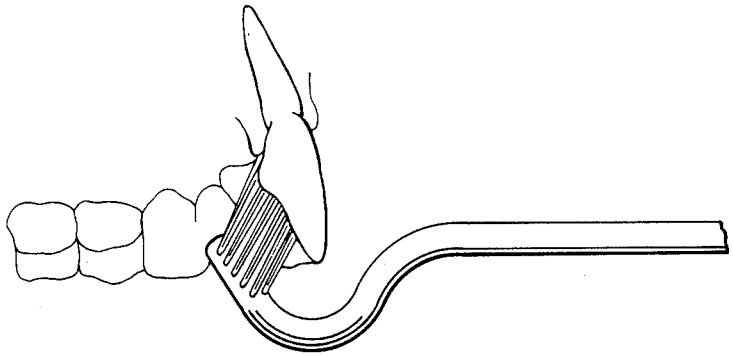
FIG. 9 is a view depicting a toothbrush constructed in accordance with another embodiment of my invention cleansing the lingual aspect of the upper dentition.

In one embodiment of my invention, shown in FIG. 5, the length L of head 53 of toothbrush 50 is shorter than the head length of many prior art toothbrushes. In this embodiment, the neck 52 is designed to include angle $\beta$ such that the head 53 of the toothbrush 50 is held approximately parallel to the long axis "A" of the teeth when the handle 51 of the toothbrush is held parallel to the occlusal plane "O". I found that this embodiment of my invention is much easier to maneuver in the manner required when using the Modified Bass technique to clean the lingual aspects 19 of the anterior teeth 18. However, there is little increase in the cleansing quality because the bristles still strike the tooth 18 and gingiva 26a (FIG. 3) at an angle of approximately 90° and impinge on the height of contour 10 of the teeth, as well as the gingiva. Angle $\beta$ (FIG. 5) is selected to be slightly (e.g., approximately 5°) greater than the approximate average angle $\gamma$ between the long axis "A" and the occlusal plane "O" for a large segment of the population. It has been reported that $\gamma$ is approximately 110°–122° for a large population, and thus $\beta$ preferrably lies within the range of approximately 95° to 155° and more desirably within the range of approximately 105° to 140°.

A second embodiment of my invention is a toothbrush that has an even smaller bristle area than in the embodiment shown in FIG. 5. By diminishing the size of the bristle area, the toothbrush of this embodiment enables the bristles to reach between the height of contour 19 (FIG. 5) and the crest 37 of the gingiva 26a (FIG. 1) and reach those areas of the teeth that are unreachable using prior art toothbrushes. This embodiment is a slight improvement over the prior art, but does not allow proper brushing of the entire lingual aspect of the teeth. As with prior art toothbrushes, the bristles of this embodiment of my invention also impinge on the gingiva and the height of contour of the tooth, and also strike the tooth at an angle of approximately 90°, rather than the 45° angle recommended by the Modified Bass technique.

A third embodiment of my invention (FIG. 6) includes, in addition to curve 60, a reverse curve 65 in the neck 61 of the toothbrush 63, thereby providing an angle $\delta$ between neck 61 and handle 62. This reverse curve 65 provides two distinct benefits as compared with prior art toothbrushes. First, the bristles 66 of the toothbrush 63 of this embodiment are closer to the occlusal plane "O". In other words, the reverse curve 65 causes the bristles to lie closer to the occlusal plane "O" when the boothbrush 63 is held in a comfortable and familiar manner by the user. Secondly, because this embodiment includes reverse curve 65, the distance between the tips of the bristles and the plane of the handle "H" is decreased over prior art toothbrushes, making the toothbrush 63 of this embodiment easier to maneuver in difficult locations. This embodiment also provides an increase in the accessibility of difficult areas as compared with prior art toothbrushes, making it much easier for the patient to brush that area. However, this embodiment does not significantly reduce the disadvantages present in my two previously described embodiments. The bristles still strike the tooth at an angle of approximately 90° and still impinge on the gingiva and height contour. Angle $\delta$ depends slightly on the length of the bristles 66 in that, for longer bristles, $\delta$ should be less than would be the case for shorter bristles. Secondly, angle $\delta$ and $\alpha$ are interrelated, such that $\theta \approx \beta + \delta - 180°$, where $\beta$ is the angle of the forward bend of a similar toothbrush as previously described in conjunction with FIG. 5. Typically, $\delta$ is within the range of 120° to 170°, $\theta$ is within the range of 45° to 130°. In one embodiment, $\theta$ is approximately 100° and $\delta$ is approximately 165°.

My fourth embodiment (FIG. 7) includes a head 71 of the toothbrush 70 which is bent back away from the bristles 72 so there is a curve on head 71, resulting in a curve on the face formed by the ends of the bristles that approximate the contour of the lingual aspect of the anterior teeth. In contrast to prior art toothbrushes, wherein all the bristles exit the toothbrush head at an angle of approximately 90°, this embodiment of my invention provides bristles which exit the toothbrush head at various angles. This unique structure greatly enhances the user's ability to provide an angle of approximately 45° between the bristles and the tooth when brushing the lingual aspect of the anterior teeth.

My fifth embodiment (also depicted in FIG. 7) includes a plurality of bristles 72 of differing lengths, with bristles having the shortest length being attached to the head of the toothbrush 70 closest to the handle 73, and bristles having the longest length being attached to the head of the toothbrush furthest away from the handle 73. The structure of this embodiment facilitates cleansing of the entire lingual aspect of the tooth, with noted improvement in the ability to cleanse the sulcus 25. Preferably, the bristles 72 are formed in order to conform to approximately the same contour and angulation of the lingual aspect 19 of the anterior teeth. Because it is desirable to mass produce a large number of identical toothbrushes for use by persons having slightly different teeth structure, it is preferable to use average values of contour and angulation of the lingual aspect of the anterior teeth in designing the exact shape of this embodiment of my invention. This embodiment of my invention provides numerous advantages compared to the toothbrushes of the prior art. First, in contrast to prior art toothbrushes, the bristles at the end of the head 71, furthest away from the handle 73 do indeed go into the sulcus 25 and strike the tooth at an angle of approximately 45°. Secondly, this embodiment of my invention cleans the entire lingual aspect 19 of anterior teeth simultaneously. Thirdly, due to the use of reverse curve 74, this embodiment has the advantage of having the toothbrush handle 73 parallel to, and as close as possible to, the occlusal plane "O".

It is desirable to maintain the same tension at the ends of each bristle, regardless of the length of the bristle. In one embodiment of this invention, where all bristles have the same diameter, the longer bristles are more flexible than the short bristles. In another embodiment, the longer bristles are constructed to have larger diameters, thereby providing a plurality of bristles having approximately equal rigidity, regardless of bristle length.

Another embodiment of my invention, shown in FIG. 8, includes reverse curve 84, which allows the toothbrush head 85 to be used substantially parallel to the long axis "A" of the teeth when the user holds the handle 81 in a comfortable and familiar position. In this embodiment of my invention, the bristles 86 are inserted in the head 85 at an angle $\alpha$ with all bristles being substantially parallel. It has been found that $\alpha$ can have a wide range of values less than 90°, preferrably within the range of approximately 30° to 70°, with approximately 45° being most suitable. In this embodiment, the head 85 of the toothbrush 80 need not be curved, thereby easing the manufacture of toothbrushes in accordance with this embodiment, yet bristles 86 do indeed strike the tooth at an angle of approximately 45° when the toothbrush handle 81 is comfortably held by the user substantially parallel to the occlusal plane "O". One way for a user to utilize this embodiment of my invention is to hold the handle 81 in a very natural, familiar, and comfortable way with the handle 81 substantially parallel to and at approximately the same level as the occlusal plane "O". The toothbrush 80 is then placed against the lingual aspect 19 of the anterior teeth. Then the user merely has to jiggle the toothbrush around and pull it forward out of the mouth, and the user is automatically performing sulcular brushing of the lingual aspect of anterior teeth utilizing the Modified Bass technique for cleansing facial aspects of the teeth. Of importance, it is unfeasible to cleanse the lingual aspects of anterior teeth in this manner when utilizing prior art toothbrushes. Similarly, this embodiment of my invention is quite suitable for proper cleansing of the distal aspects of the most distal teeth.

The advantages of the toothbrush constructed in accordance with this embodiment of my invention are that all the bristles are the same length, made out of the same material (typically nylon) and have the same diameter and will display the same rigidity. This greatly simplifies manufacture of the toothbrush as compared with toothbrushes having bristles of various lengths, materials, diameters, and angles of exit from the toothbrush head. Furthermore, utilizing such uniform bristles provides that all bristles have approximately uniform abrasive values. The toothbrush constructed in accordance with this embodiment of my invention is suitable for cleansing the lingual aspects of anterior teeth and the distal aspects of the most distal teeth, and the distal aspect of teeth adjacent to edentulous areas. Additionally, the neck and handle of the toothbrush can, for example, be made out of a malleable material, for example a malleable plastic, the could, if desired, be bent to accommodate an individual whose teeth are in a greater or lesser inclination than the average values. In other words, if a user has teeth that, for example, are pointed inward, the user could increase the bend 83 (FIG. 8) in the neck of the toothbrush simply by pressing on the head of the toothbrush and bending it down so the head of the toothbrush is parallel to the user's teeth.

While specific examples of my invention have been described in this specification, the specific examples are intended to be illustrative only and are not intended to be limitations on a scope of my invention. Numerous other embodiments of my invention will become readily apparent to those of ordinary skill in the art in light of the teachings of this specification.

I claim:

1. A toothbrush comprising:

a handle;

a plurality of bristles;

a head for holding said bristles;

a neck for connecting said handle and said head with an offset angle formed therebetween, wherein said neck causes said offset angle to approximately equal the average value of the long axis of the anterior teeth of the population, said offset angle being within the range of approximately 110°–122° such that when said toothbrush is used to clean the lingual aspects of the anterior teeth said head is approximately parallel to the long axis of the anterior teeth, and said handle is approximately parallel to the occlusal plane, wherein said neck further provides a reverse angle, said reverse angle in the neck providing an angle between the neck and the handle within the range of approximately 120°–170°, wherein when said toothbrush is used to clean the lingual aspects of the anterior teeth, said handle is approximately parallel to said occulsal plane and lies closer to said occlusal plane than would be the case if said reverse angle were not used, and wherein said bristles exit said head at an exit angle of approximately 45° measured between the length of said bristles and that portion of said head furthest from said neck, said bristles being substantially parallel with teach other and the same length.

* * * * *